US010030420B2

(12) United States Patent
Jidaisho

(10) Patent No.: US 10,030,420 B2
(45) Date of Patent: Jul. 24, 2018

(54) VEHICLE DOOR LOCK DEVICE

(71) Applicant: AISIN SEIKI KABUSHIKI KAISHA, Kariya-shi, Aichi-ken (JP)

(72) Inventor: Kiyotaka Jidaisho, Kariya (JP)

(73) Assignee: AISIN SEIKI KABUSHIKI KAISHA, Kariya, Aichi-Ken (JP)

( * ) Notice: Subject to any disclaimer, the term of this patent is extended or adjusted under 35 U.S.C. 154(b) by 119 days.

(21) Appl. No.: 15/134,823

(22) Filed: Apr. 21, 2016

(65) Prior Publication Data

US 2016/0312498 A1 Oct. 27, 2016

(30) Foreign Application Priority Data

Apr. 23, 2015 (JP) ..... 2015-088483

(51) Int. Cl.
*E05B 3/06* (2006.01)
*E05B 77/38* (2014.01)
(Continued)

(52) U.S. Cl.
CPC ..... *E05B 77/38* (2013.01); *E05B 79/10* (2013.01); *E05B 81/06* (2013.01); *E05B 81/16* (2013.01); *E05B 85/243* (2013.01); *E05B 81/36* (2013.01)

(58) Field of Classification Search
CPC ..... E05C 3/36; E05B 15/16; E05B 17/0045; E05B 77/36; E05B 77/38; E05B 77/40; E05B 81/34; E05B 81/36; E05B 81/06; E05B 81/16; E05B 79/10; E05B 17/0041; E05B 77/42; E05B 2047/002; E05B 2047/0021; E05B 85/243; Y10S 292/56; Y10S 292/73; Y10T 292/0823; Y10T 292/0843; Y10T 292/0856; Y10T 292/0916; Y10T 292/0966;
(Continued)

(56) References Cited

U.S. PATENT DOCUMENTS 4,783,103 A * 11/1988 Schlegel ..... E05B 85/26 292/216
4,904,006 A * 2/1990 Hayakawa ..... E05B 81/06 292/201
(Continued)

FOREIGN PATENT DOCUMENTS

DE 10216313 A1 * 10/2003 ..... E05B 77/38
DE 102004049401 A1 * 4/2006 ..... E05B 81/06
(Continued)

*Primary Examiner* — Christine M Mills
(74) *Attorney, Agent, or Firm* — Buchanan Ingersoll & Rooney PC

(57) ABSTRACT

A vehicle door lock device includes: a latch mechanism configured to be capable of holding a vehicle door in a closed state with respect to a vehicle body; and a lock mechanism that sets the latch mechanism to an unlock state in which engagement between the latch mechanism and a striker provided in the vehicle body can be released, or a lock state in which engagement between the latch mechanism and the striker cannot be released, wherein the lock mechanism includes a drive gear driven by an electric motor, a wheel gear including a body portion, a gear portion, locking portions, and an engaging protrusion, an active lever including an engaging recess, stoppers, and a shock absorbing member including interposed portions.

1 Claim, 11 Drawing Sheets

(51) Int. Cl.

| | |
|---|---|
| ***E05B 81/06*** | (2014.01) |
| ***E05B 81/16*** | (2014.01) |
| ***E05B 79/10*** | (2014.01) |
| ***E05B 85/24*** | (2014.01) |
| *E05B 81/36* | (2014.01) |

(58) Field of Classification Search
CPC ..... Y10T 292/0993; Y10T 292/1018; Y10T 292/1079; Y10T 292/307; Y10T 292/308
USPC ..... 292/22, 39, 51, 112, 160, 172, 142, 199, 292/279, 280, DIG. 56, DIG. 73
See application file for complete search history.

(56) References Cited

U.S. PATENT DOCUMENTS

| | | | | | |
|---|---|---|---|---|---|
| 5,020,838 | A * | 6/1991 | Fukumoto | E05B 81/14 | 292/201 |
| 5,035,453 | A * | 7/1991 | Fukumoto | E05B 81/06 | 292/216 |
| 7,195,292 | B2 * | 3/2007 | Ketelsen | E05B 85/26 | 292/201 |
| 8,303,003 | B2 * | 11/2012 | Berghahn | E05B 81/14 | 292/201 |
| 2003/0113133 | A1 | 6/2003 | Ryuzaki et al. | | |
| 2005/0156447 | A1 * | 7/2005 | Bishop | E05B 17/0037 | 296/76 |
| 2006/0075841 | A1 * | 4/2006 | Kachouh | E05B 81/25 | 74/425 |
| 2012/0256429 | A1 * | 10/2012 | Nagaoka | E05B 77/34 | 292/200 |
| 2017/0138096 | A1 * | 5/2017 | Zhang | E05B 81/36 | |

FOREIGN PATENT DOCUMENTS

| | | | | | |
|---|---|---|---|---|---|
| DE | 102006025719 | A1 * | 12/2007 | E05B 85/26 | |
| DE | 102006028423 | A1 * | 12/2007 | E05B 85/26 | |
| EP | 0684356 | A1 * | 11/1995 | E05B 81/25 | |
| JP | 02190587 | A * | 7/1990 | | |
| JP | 09-26001 | A | 1/1997 | | |
| JP | 09-250606 | A | 9/1997 | | |
| JP | 2003-240065 | A | 8/2003 | | |
| JP | 2008-248591 | A | 10/2008 | | |
| JP | 2012225112 | A * | 11/2012 | E05B 15/04 | |

* cited by examiner

VEHICLE DOOR LOCK DEVICE

CROSS REFERENCE TO RELATED APPLICATIONS

This application is based on and claims priority under 35 U.S.C. § 119 to Japanese Patent Application 2015-088483, filed on Apr. 23, 2015, the entire contents of which are incorporated herein by reference.

TECHNICAL FIELD

This disclosure relates to a vehicle door lock device assembled to a vehicle door.

BACKGROUND DISCUSSION

A vehicle door lock device in the related art is known which includes a lock mechanism that sets engagement between a vehicle door side latch mechanism and a vehicle body side striker to a releasable unlock state or an unreleasable lock state. For example, JP 2008-248591A (Reference 1) discloses one of the door lock devices of this type. The door lock device (hereinafter, also referred to as a "device in the related art") includes an actuator that rotates a wheel gear (rotating member) by a drive force of a motor, and an active lever (operating lever) that is turned between an unlock position at which the latch mechanism is set to the unlock state during operation of the actuator and a lock position at which the latch mechanism is set to the lock state. In the door lock device, during rotation of the wheel gear, the active lever is rotated while being engaged with the wheel gear via a protrusion of the wheel gear, and comes into contact with a stopper of a housing at each of the unlock position and the lock position such that the rotation of the active lever is limited.

There is demand for reducing operation noise of the door lock device, which is induced by an operation of the actuator. An example of the induced operation noise is striking noise (contact noise) occurring when the active lever comes into contact with either the wheel gear or the stopper. In contrast, the stopper formed as an elastic member, which comes into contact with the active lever, is incorporated into the device in the related art only as a countermeasure, and this countermeasure is not sufficient in fundamentally solving the problem of striking noise induced by an operation of the actuator. In contrast, in a case where countermeasures are respectively implemented for multiple striking noise-inducing regions in which striking noise is assumed to be induced, there is a problem in that a product cost is increased.

SUMMARY

Thus, a need exists for technology which is not suspectable to the drawback mentioned above.

A vehicle door lock device according to an aspect of this disclosure is assembled to a vehicle door and includes a latch mechanism and a lock mechanism. The latch mechanism is configured to be capable of holding the vehicle door in a closed state with respect to a vehicle body. The lock mechanism serves to set the latch mechanism to an unlock state in which engagement between the latch mechanism and a striker provided in the vehicle body can be released, or a lock state in which engagement between the latch mechanism and the striker cannot be released. The lock mechanism further includes a drive gear, a wheel gear, an active lever, stoppers, and one shock absorbing member.

The drive gear is driven by an electric motor. The wheel gear includes a body portion that is rotatably supported by a housing; a gear portion that is provided along an outer circumference of the body portion and includes gear teeth on an outer circumferential surface of the body portion, which is engaged with the drive gear; locking portions that are respectively provided in circumferential end portions of the gear portion, and an engaging protrusion that is provided in the body portion and protrudes toward the radial outside of the body portion. The active lever includes an engaging recess that can be engaged with the engaging protrusion of the wheel gear. The active lever is turned in either direction of a first direction from an unlock position at which the latch mechanism is set to the unlock state toward a lock position at which the latch mechanism is set to the lock state, or a second direction from the lock position toward the unlock position, in a state where the engaging protrusion is engaged with the engaging recess during rotation of the wheel gear. The active lever locks the wheel gear at each of the unlock position and the lock position. The stoppers are respectively provided on both sides of the active lever in the housing, prevent further turning of the active lever, which has been turned from the lock position to the unlock position, in the first direction, and prevent further turning of the active lever, which has been turned from the unlock position to the lock position, in the second direction.

The shock absorbing member is attached to the active lever, includes a plurality of interposed portions which are integrally formed and are interposed in at least two regions among a first region between the active lever and the stopper of the housing, a second region between the active lever and the locking portion of the wheel gear, and a third region between the engaging recess of the active lever and the engaging protrusion of the wheel gear, and is made of a shock absorbing material. In this case, the interposed portions of the shock absorbing member are respectively interposed in two or more regions selected from three regions.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
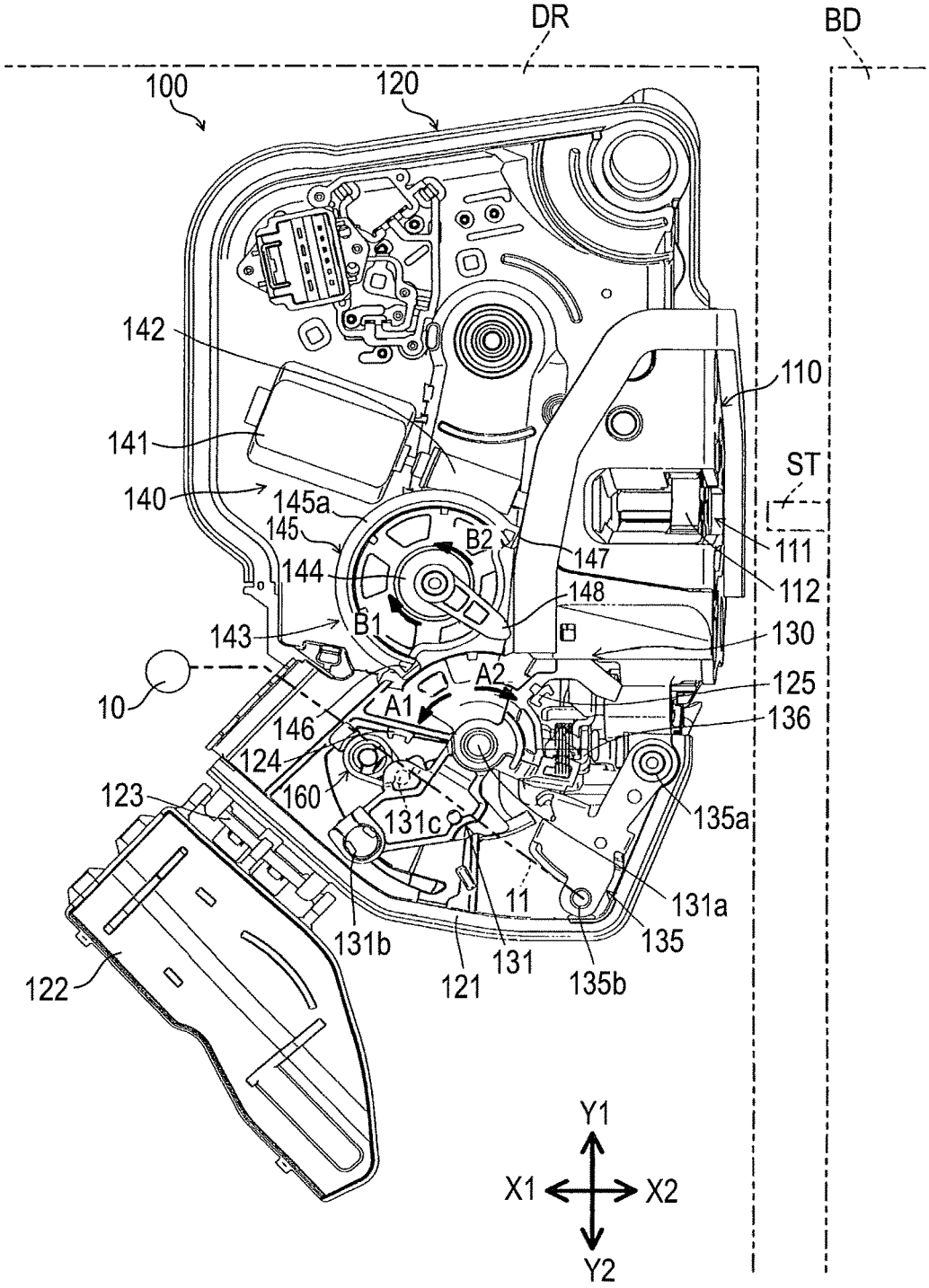
FIG. 1 is a view illustrating the internal structure of a vehicle door lock device in an embodiment.

Hereinafter, a vehicle door lock device in an embodiment disclosed herein will be described with reference to the accompanying drawings. In the drawings, arrows X1 and X2 respectively represent front and rear sides of a vehicle, arrows Y1 and Y2 respectively represent upper and lower sides of the vehicle, and arrows Z1 and Z2 respectively represent the inside and outside of the vehicle. The definition of these directions can be applied to a vehicle door lock device that is not attached to a vehicle door, and a vehicle door lock device that is attached to a vehicle door.

A vehicle door lock device (hereinafter, simply referred to as a "door lock device") 100 illustrated in FIG. 1 is mounted in a region bound by an outer door panel (vehicle outside panel) and an inner door panel (vehicle inside panel) of a vehicle door DR. FIG. 1 illustrates a right side vehicle door as an example of the vehicle door DR. The door lock device is equivalent to a "vehicle door lock device" disclosed herein.

The door lock device 100 includes a meshing body 110 and an actuator body 120. The meshing body (also referred to as a "lock body") 110 is assembled to a vehicle rear side (the right side in FIG. 1) of the actuator body 120.

The meshing body 110 accommodates a latch mechanism 111. As is well known, the latch mechanism 111 holds the vehicle door DR in a closed state with respect to a vehicle body BD. The latch mechanism 111 includes a latch 112 that is capable of being engaged with and disengaged from a striker ST fixed to the vehicle body BD. In a case where the latch 112 is engaged with the striker ST and an engaged state is maintained, the closed state (latched state) of the vehicle door DR is held. In contrast, in a case where engagement between the latch 112 and the striker ST is released and the striker ST is disengaged from the latch, the state of the vehicle door DR transitions from the closed state to an open state (unlatched state). The latch mechanism 111 is equivalent to a "latch mechanism" disclosed herein. A "latch mechanism 10" disclosed in JP 2013-130028A is referred to for details of the latch mechanism.

The actuator body 120 includes a housing 121 made of resin, and the housing 121 accommodates a lock mechanism 130. A cover 122 is attached to the housing 121 via a hinge mechanism 123. The cover 122 is configured to be capable of being turned around the hinge mechanism 123 as the center of turning between an open position illustrated in FIG. 1 and a closed position at which the cover 122 covers a connection unit 11 (to be described later). The lock mechanism 130 serves to set the latch mechanism 111 to an unlock state in which engagement between the latch mechanism 111 and the striker ST can be released, or a lock state in which engagement between the latch mechanism 111 and the striker ST cannot be released. The lock mechanism 130 includes an active lever 131; an inside opening lever 135; an outside opening lever 136; and an actuator 140. The lock mechanism 130 is equivalent to a "lock mechanism" disclosed herein.

The active lever 131 is configured to be turned around a lever support shaft 131*a* in either direction of a clockwise direction or a counterclockwise direction between an unlock position at which an opening link (not illustrated) is set to an unlock position (first position) and a lock position at which the opening link is set to a lock position (second position). The housing 121 includes two stoppers 124 and 125 which are respectively provided on both sides of the active lever 131. The stopper 124 is configured to come into contact with the active lever 131 that has been turned from the lock position to the unlock position, and to prevent turning of the active lever 131 in a first direction A1. The stopper 125 is configured to come into contact with the active lever 131 that has been turned from the unlock position to the lock position, and to prevent turning of the active lever 131 in a second direction A2. The stoppers 124 and 125 are equivalent to "stoppers" disclosed herein.

A spring 160 assembled to the housing 121 is bound to the active lever 131, and the active lever 131 is provided with an engaging pin 131*c* engaged with the spring 160. For this reason, when the active lever 131 is present in a turning range from the unlock position to a neutral region between the unlock position and the lock position, the spring 160 is configured to elastically bias the active lever 131 in the first direction A1. For this reason, the active lever 131 at the position of contact with the stopper 124 is elastically biased in the first direction A1 by the spring 160 such that the active lever 131 is held at that position. In contrast, when the active lever 131 is present in a turning range from the lock position to the neutral region, the spring 160 is configured to elastically bias the active lever 131 in the second direction A2. For this reason, the active lever 131 at the position of contact with the stopper 125 is elastically biased in the second direction A2 by the spring 160 such that the active lever 131 is held at that position. As such, the spring 160 is formed as a so-called "click spring" that is capable of switching the elastic biasing direction of the active lever 131 with respect to the neutral region as a boundary, and switching the rotational position of the active lever 131 in a clicking manner.

The inside opening lever 135 is configured to be turned around the lever support shaft 135*a* in either direction of the clockwise direction or the counterclockwise direction. The inside opening lever 135 includes an attachment portion 135*b* to which the connection unit 11 such as a wire cable and a rod, which is connected to an inside door handle 10 of the vehicle door, is attached. For this reason, the inside opening lever 135 is operated when a door opening operation of the inside door handle 10 is performed. The outside opening lever 136 is operated when a door opening operation of an outside door handle (not illustrated) is performed. The opening link is configured to be operated between the unlock position and the lock position by the operation of the door handle (the inside opening lever 135 or the outside opening lever 136). Accordingly, in a case where the opening link is set to the unlock position in a state where the vehicle door DR is closed, when a door opening operation of the door handle is performed, the state of the latch mechanism 111 transitions from the latched state to the unlatched state, and the vehicle door DR is unlocked. In contrast, in a case where the opening link is set to the lock position in a state where the vehicle door DR is closed, even if a door opening operation of the door handle is performed, the latched state of the latch mechanism 111 is maintained, and the locking of the vehicle door DR is not released.

The active lever 131 is made of a resin material, and is formed as an operating lever that is turned between the unlock position and the lock position when a lock and unlock operation member is operated. The lock and unlock operation member includes a lock knob (not illustrated) provided inside of the vehicle door DR, a key cylinder (not illustrated) that can be operated from the outside of the vehicle door DR, and a remote control (not illustrated) for operating the actuator 140. An operation portion 131*b* of the active lever 131 is connected to the lock knob via an operation cable (not illustrated). An engaging portion of the active lever 131 is linked to the key cylinder via a linkage mechanism (not illustrated) including a locking control lever, a key switch lever, and an outside locking lever.

The actuator 140 is configured to include an electric motor 141 that is operated by operation of the remote control which is one of the lock and unlock operation members; a worm gear 142 as a drive gear that is driven by the electric motor 141; and a disc-shaped wheel gear 143 that is engaged with the worm gear 142 and the active lever 131. The wheel gear 143 is a driven gear driven by the worm gear 142. The wheel gear 143 is made of a resin material, and includes a disc-shaped body portion 144 that is rotatably supported by the housing 121, and an arc-shaped gear portion 145 that is provided along an arc-shaped outer circumference of the body portion 144, and includes gear teeth 145*a* on the arc-shaped outer circumferential surface of the body portion 144, which is engaged with the worm gear 142. That is, the wheel gear 143 is different from a wheel gear including gear teeth provided on the entire circumference of the wheel gear. The wheel gear 143 has a shape in which a portion of a gear tooth row is eliminated in a circumferential direction. As a result, a locking portion 146 is provided at one arc-shaped end of two arc-shaped ends (circumferential end portions) of the gear portion 145, and a locking portion 147 is provided at the other arc-shaped end. The locking portions 146 and 147 are equivalent to "locking portions" disclosed herein. The body portion 144 is provided with an engaging protrusion 148 that protrudes from a central portion of the body portion 144 toward the radial outside of the body portion 144 through a region between the two locking portions 146 and 147. The engaging protrusion 148 is equivalent to an "engaging protrusion" disclosed herein. For this reason, a drive force of the electric motor 141 is transmitted to the wheel gear 143 via the worm gear 142. The active lever 131 is turned by rotation of the wheel gear 143. The worm gear 142 and the wheel gear 143 referred to here are respectively equivalent to a "drive gear" and a "wheel gear" disclosed herein.

Figure 2:
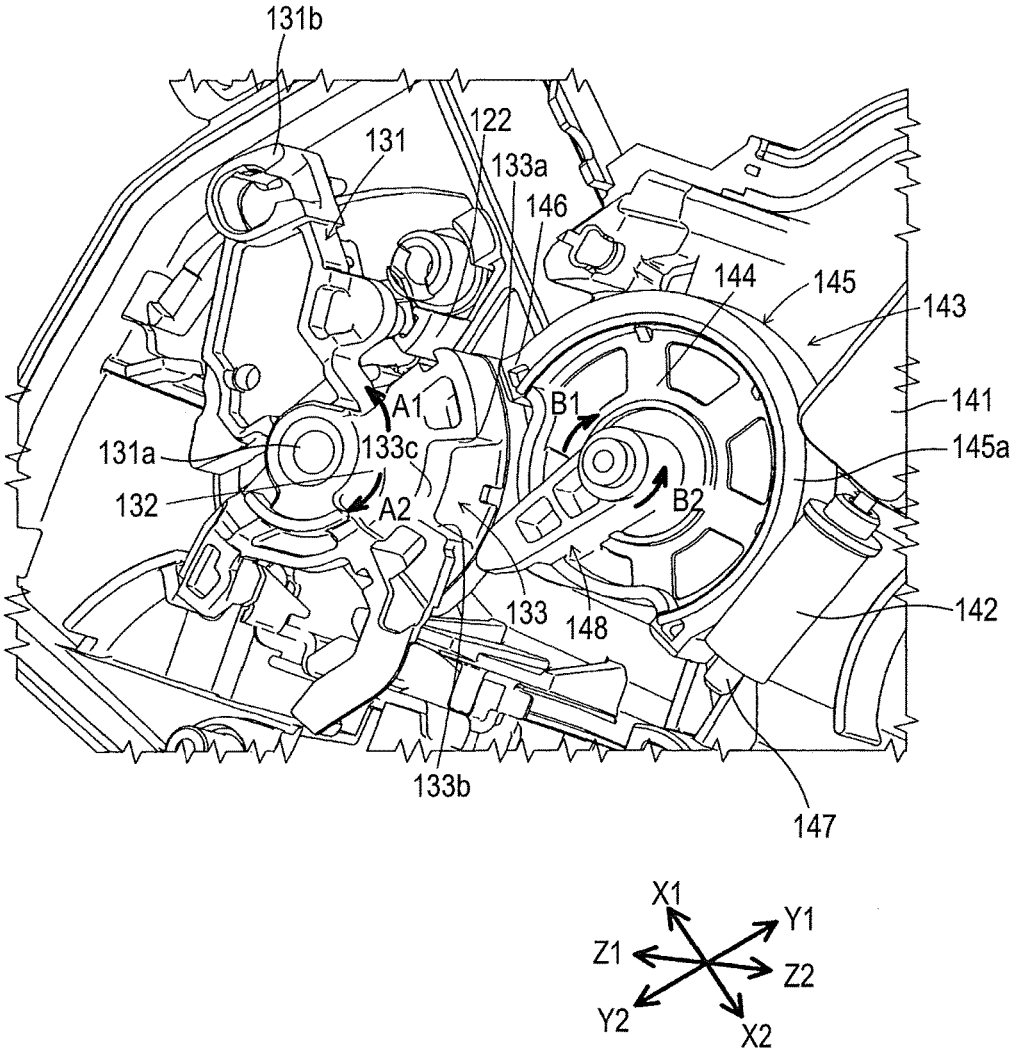
FIG. 2 is a perspective view illustrating the structure of the vicinity of an active lever and a wheel gear in FIG. 1.

As illustrated in FIG. 2, the active lever 131 includes a fan-shaped engaging arm 132 that extends from the lever support shaft 131*a* toward the worm gear 142. The engaging arm 132 includes an engaging recess 133 which is provided on an extending plane of the engaging protrusion 148 of the wheel gear 143 and on a surface of the engaging arm 132 facing the engaging protrusion 148 such that the engaging recess 133 can be engaged with the engaging protrusion 148. The engaging recess 133 is a recessed portion that is bound by side walls 133*a* and 133*b* facing each other, and a bottom wall 133*c* extending between the side wall 133*a* and the side wall 133*b*, and is a space for engagement with the engaging protrusion 148. For this reason, when the wheel gear 143 is rotated in a first direction B1, the engaging protrusion 148 presses one side wall 133*a* of the engaging recess 133 while being engaged with (is in contact with) the one side wall 133*a*, and thus, the active lever 131 is turned around the lever support shaft 131*a* as the center of turning from the unlock position to the lock position in the first direction A1. Similarly, when the wheel gear 143 is rotated in a second direction B2, the engaging protrusion 148 presses the other side wall 133*b* of the engaging recess 133 while being engaged with (is in contact with) the other side wall 133*b*, and thus, the active lever 131 is turned around the lever support shaft 131*a* as the center of turning from the lock position to the unlock position in the second direction A2. The active lever 131 is equivalent to an "active lever" disclosed herein.

Figure 3:
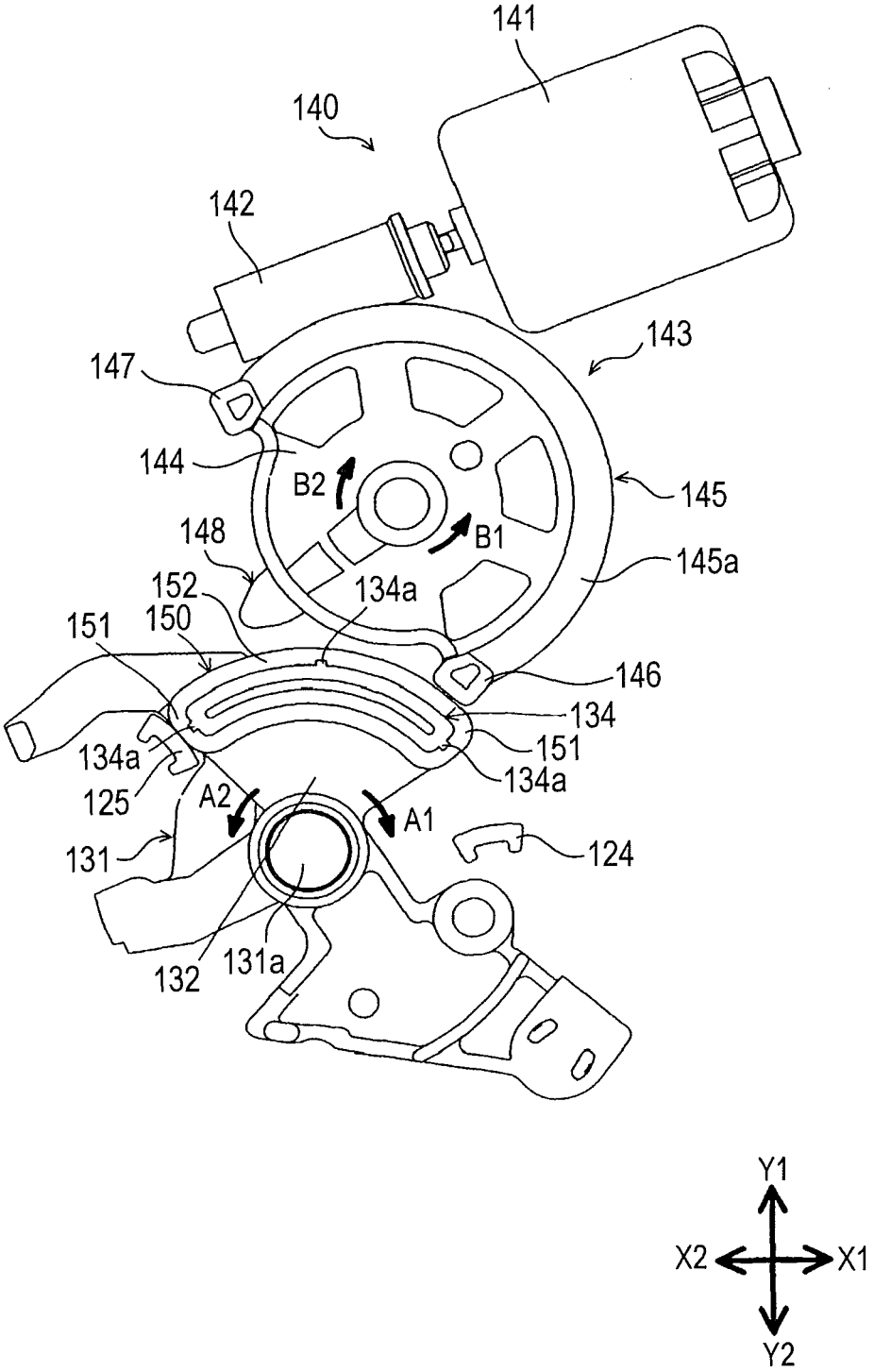
FIG. 3 is a view illustrating the state of engagement between the active lever at an unlock position and the wheel gear, viewed from a vehicle exterior side.
Figure 4:
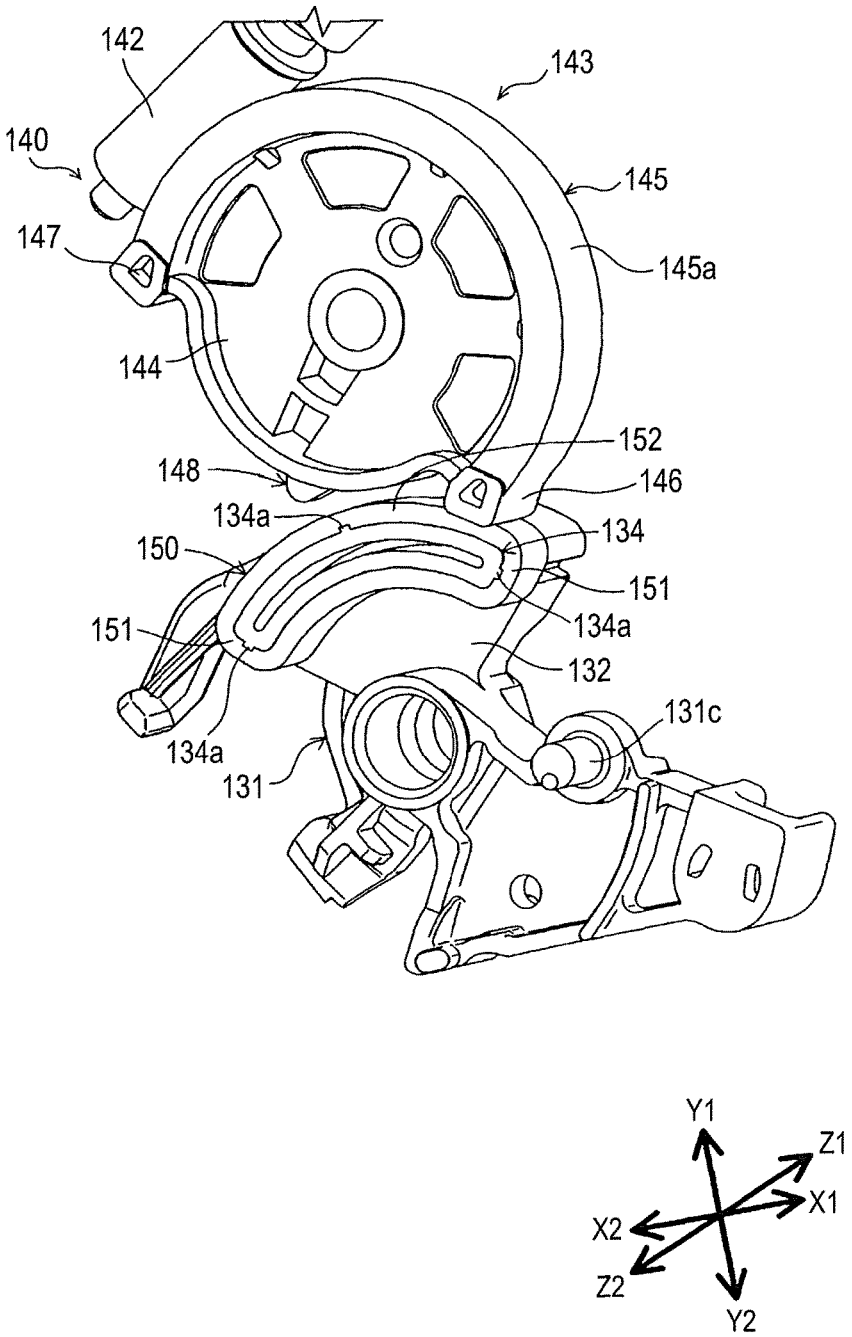
FIG. 4 is a view illustrating the state of engagement between the active lever at the unlock position and the wheel gear, viewed in a diagonal direction.

As illustrated in FIGS. 3 and 4, a holding portion 134 is provided in the engaging arm 132 of the active lever 131. The holding portion 134 is configured to extend along an arc line that is concentric with the lever support shaft 131*a* which is the center of turning of the active lever 131, and to protrude in an axial direction (toward a vehicle exterior side) of the lever support shaft 131*a* which is the direction of a rotational axis of the active lever 131. A belt member 150 made of rubber, which is a shock absorbing material, is fitted and attached to the holding portion 134 such that the belt member 150 is held by the holding portion 134. The holding portion 134 is equivalent to a "holding portion" disclosed herein. A plurality of (three in FIG. 3) retainers 134*a* are provided in an edge portion of the holding portion 134 so as to prevent falling out of the belt member 150 from the holding portion 134 to which the belt member 150 is fitted. The belt member 150 is reliably held by the active lever 131 by virtue of the retainers 134*a*.

The belt member 150 includes interposed portions 151, 151 and an interposed portion 152, and has an annular structure in which the interposed portions are integrally formed. The interposed portions 151, 151 are interposed in a first region between the holding portion 134 of the active lever 131 and the stoppers 124 and 125 of the housing 121. Accordingly, the holding portion 134 is configured to be capable of coming into contact with the stoppers 124 and 125 via the respective interposed portions 151, 151 of the belt member 150. The interposed portion 152 is interposed in a second region between the holding portion 134 of the active lever 131 and the locking portions 146 and 147 of the wheel gear 143. Accordingly, the holding portion 134 is configured to be capable of coming into contact with the locking portions 146 and 147 via the interposed portion 152 of the belt member 150. The belt member 150 is equivalent to a "shock absorbing member" and a "belt member" disclosed herein.

Hereinafter, a turning operation of the active lever 131 with the aforementioned configuration from the unlock position to the lock position performed by the actuator 140 will be described with reference to FIGS. 5 to 7 in addition to FIG. 3. A turning operation of the active lever 131 from the lock position to the unlock position can be described in a sequence reverse to that of the following operation, and thus description thereof will be omitted.

In a state where the active lever 131 is present at the unlock position illustrated in FIG. 3, the locking portion 146 of the wheel gear 143 is in contact with the holding portion 134 of the active lever 131 via the interposed portion 152 of the belt member 150. In this state, the active lever 131 locks the wheel gear 143 at the unlock position due to contact between the wheel gear 143 and the interposed portion 152. When the wheel gear 143 is rotated in the first direction B1, the engaging recess 133 of the active lever 131 is engaged with the engaging protrusion 148 of the wheel gear 143, and the turning position of the active lever 131 sequentially transitions to states illustrated in FIGS. 5 and 6. The first position illustrated in FIG. 5 is a position to which the engaging protrusion 148 of the wheel gear 143 is turned a predetermined angle from an initial position in the first direction B1. The second position illustrated in FIG. 6 is a position to which the engaging protrusion 148 is further turned from the first position in the first direction B1.

Figure 5:
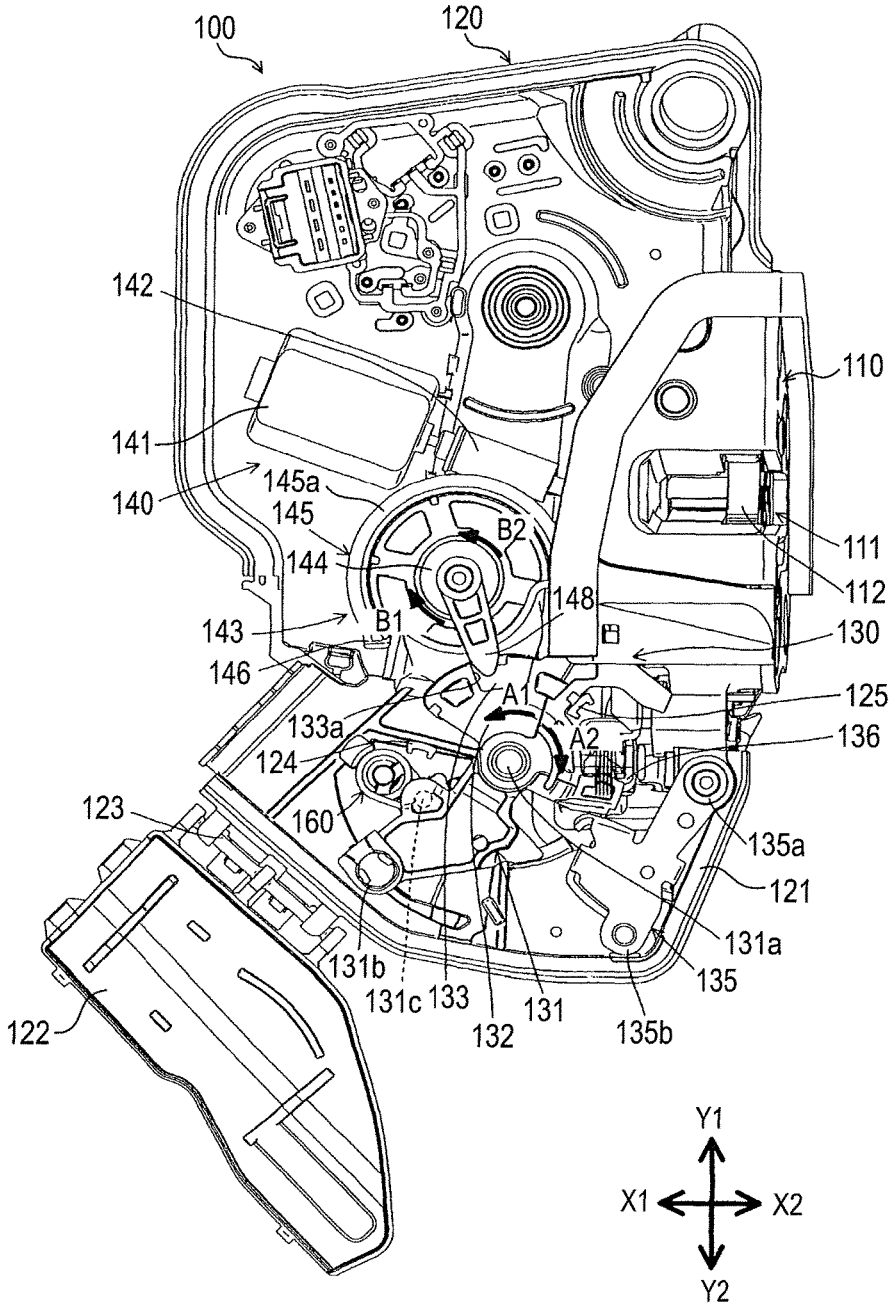
FIG. 5 is a view illustrating a state in which an engaging protrusion of the wheel gear is in contact with an engaging recess of the active lever at the unlock position in FIG. 1.

As illustrated in FIG. 5, when the engaging protrusion 148 of the wheel gear 143 reaches the first position, the engaging protrusion 148 comes into contact with the side wall 133*a* of the engaging recess 133. The active lever 131 is pressed toward the lock position by further turning of the engaging protrusion 148 in the first direction B1. Accordingly, the active lever 131 is turned in the first direction A1 overcoming an elastic biasing force (force to bias the active lever 131 in the second direction A2) of the spring 160. During this process, the elastic biasing direction of the spring 160 is switched, and thereafter, the active lever 131 is turned in the first direction A1 according to the elastic biasing force of the spring 160.

Figure 6:
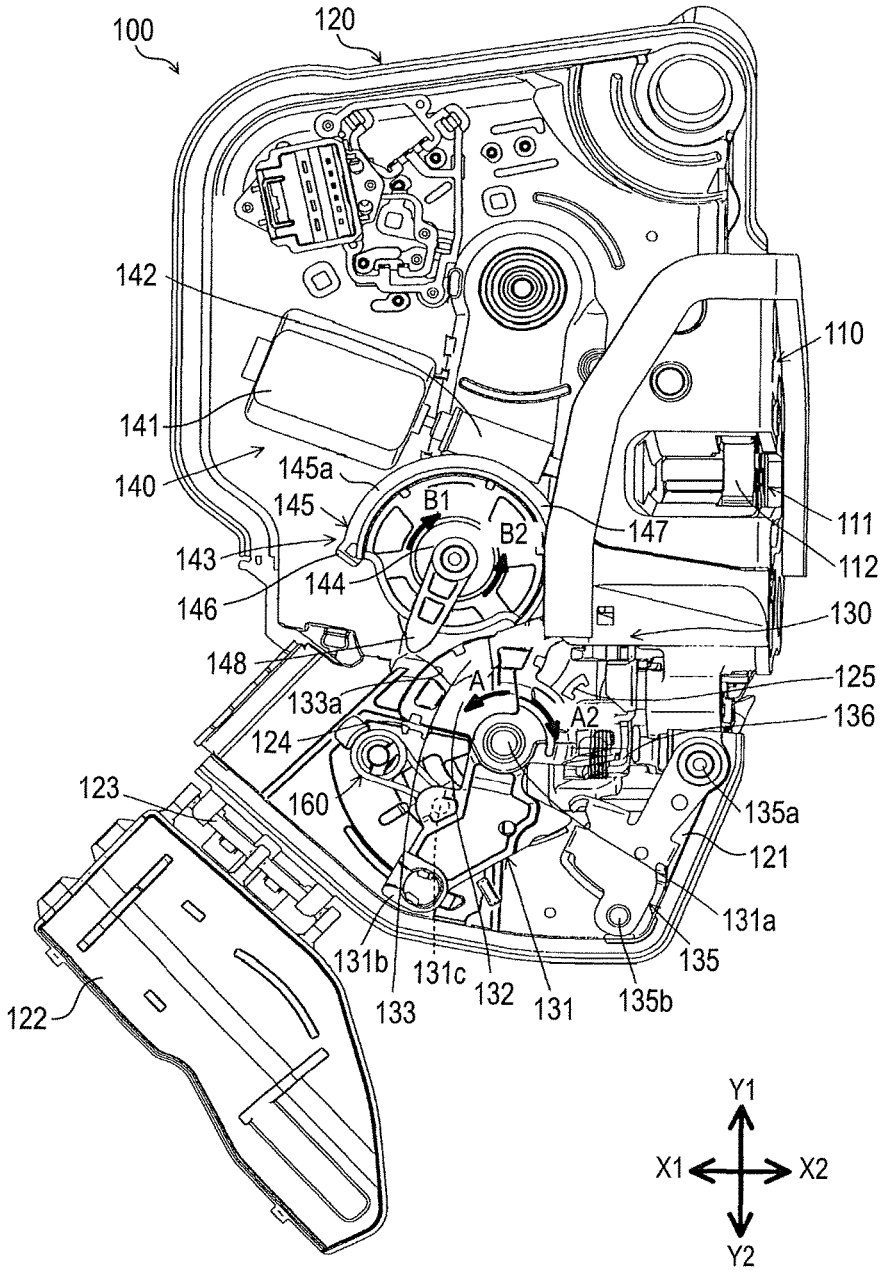
FIG. 6 is a view illustrating the state of engagement between the active lever at a lock position and the wheel gear in FIG. 1.
Figure 7:
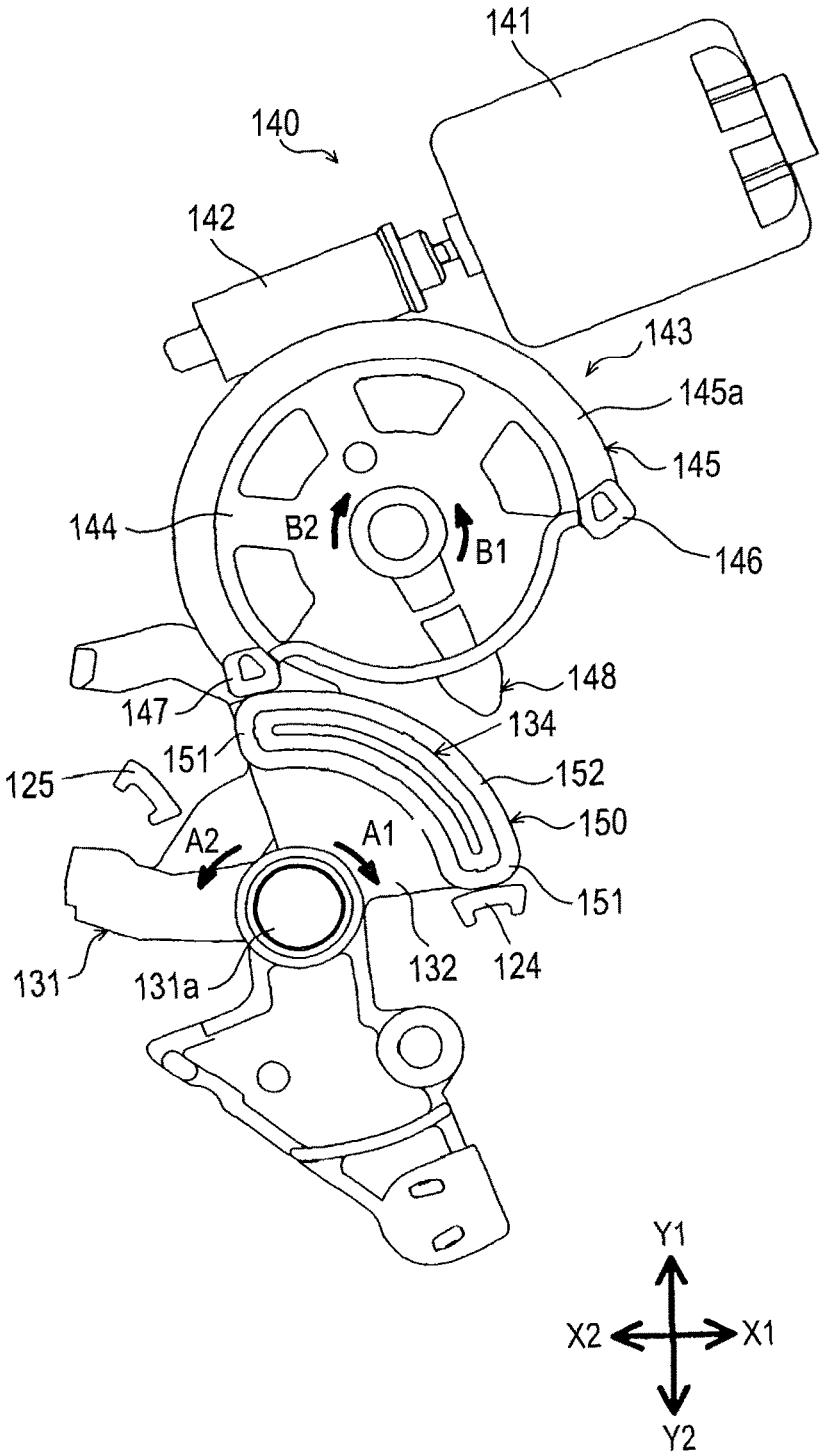
FIG. 7 is a view illustrating the state of engagement between the active lever at the lock position and the wheel gear, viewed from the vehicle exterior side.

As illustrated in FIGS. 6 and 7, when the active lever 131 is turned to the lock position, the locking portion 147 of the wheel gear 143 comes into contact with the holding portion 134 of the active lever 131 via the interposed portion 152 of the belt member 150. The active lever 131 locks the wheel gear 143 at the lock position due to contact between the wheel gear 143 and the interposed portion 152. In this case, since the locking portion 147 is indirectly engaged with the holding portion 134 in a state where the interposed portion 152 of the belt member 150 made of rubber is interposed between the locking portion 147 and the holding portion 134, striking noise induced by engagement is reduced. Thereafter, the holding portion 134 of the active lever 131 comes into contact with the stopper 124 of the housing 121 via the interposed portion 151 of the belt member 150. As a result, the turning of the active lever 131 in the first direction A1 is prevented by the stopper 124. In this case, since the stopper 124 is indirectly engaged with the holding portion 134 with the belt member 150 made of rubber interposed between the stopper 124 and the holding portion 134, striking noise induced by engagement is reduced.

In the door lock device 100 with the aforementioned configuration, the belt member 150 is capable of reducing operation noise (striking noise) induced by engagement between the active lever 131 and the stopper 124 or 125 and between the active lever 131 and the wheel gear 143 during an operation of the actuator 140. Particularly, since one common belt member 150 is used for the first and second regions which are striking noise-inducing regions, it is possible to simplify the structure and to reduce the product cost. Even if the number of interposed portions is small, it is possible to obtain a significant effect of preventing the induction of striking noise by interposing a portion of the belt member 150 in at least the second region.

In the door lock device 100 with the aforementioned configuration, the structure of the active lever 131 can be changed. The structure of an active lever 231 which is a modification example of the active lever 131 will be illustrated with reference to FIGS. 8 and 9.

Figure 8:
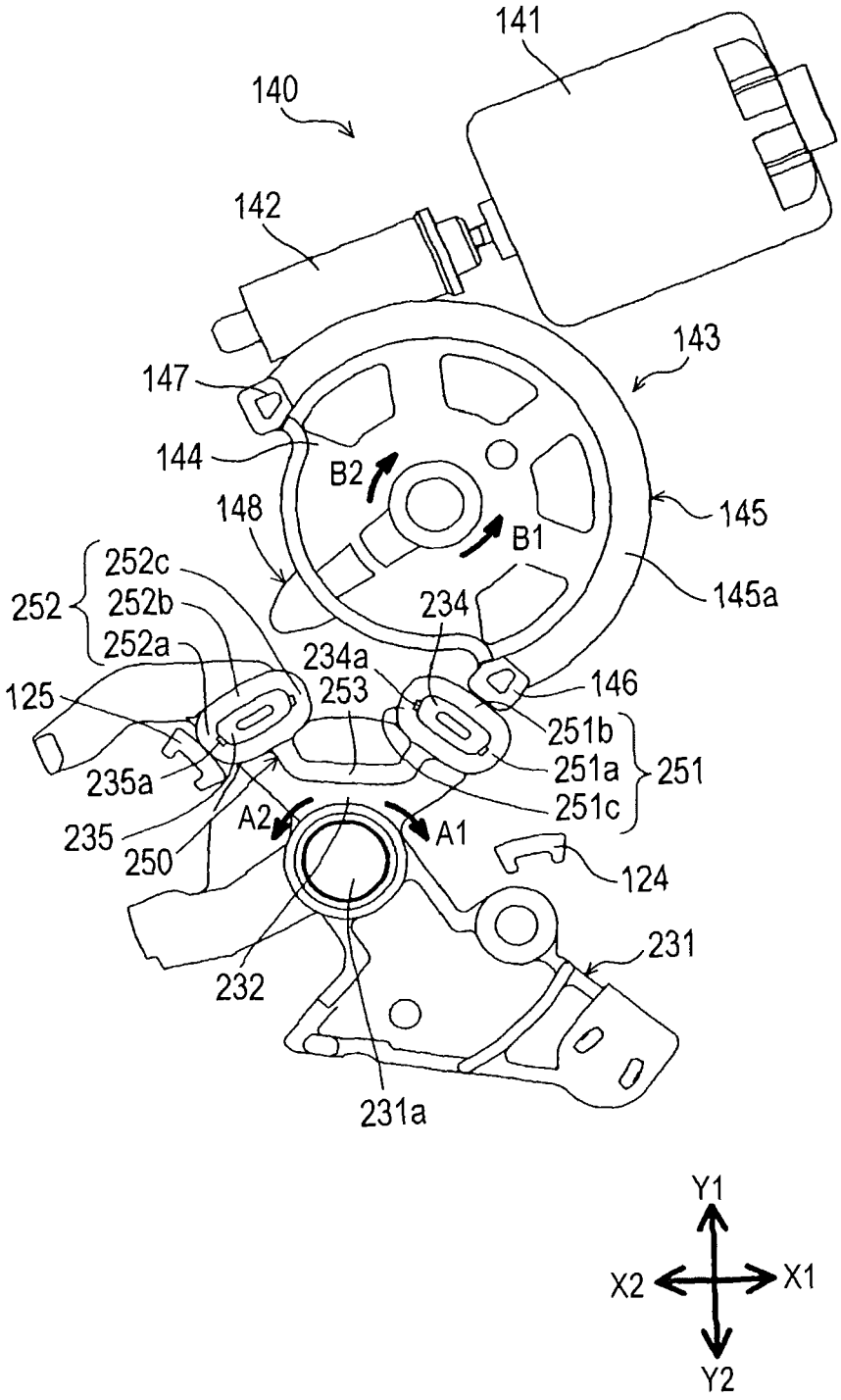
FIG. 8 is a view illustrating the state of engagement between the active lever at the unlock position and the wheel gear, viewed from the vehicle exterior side.
Figure 9:
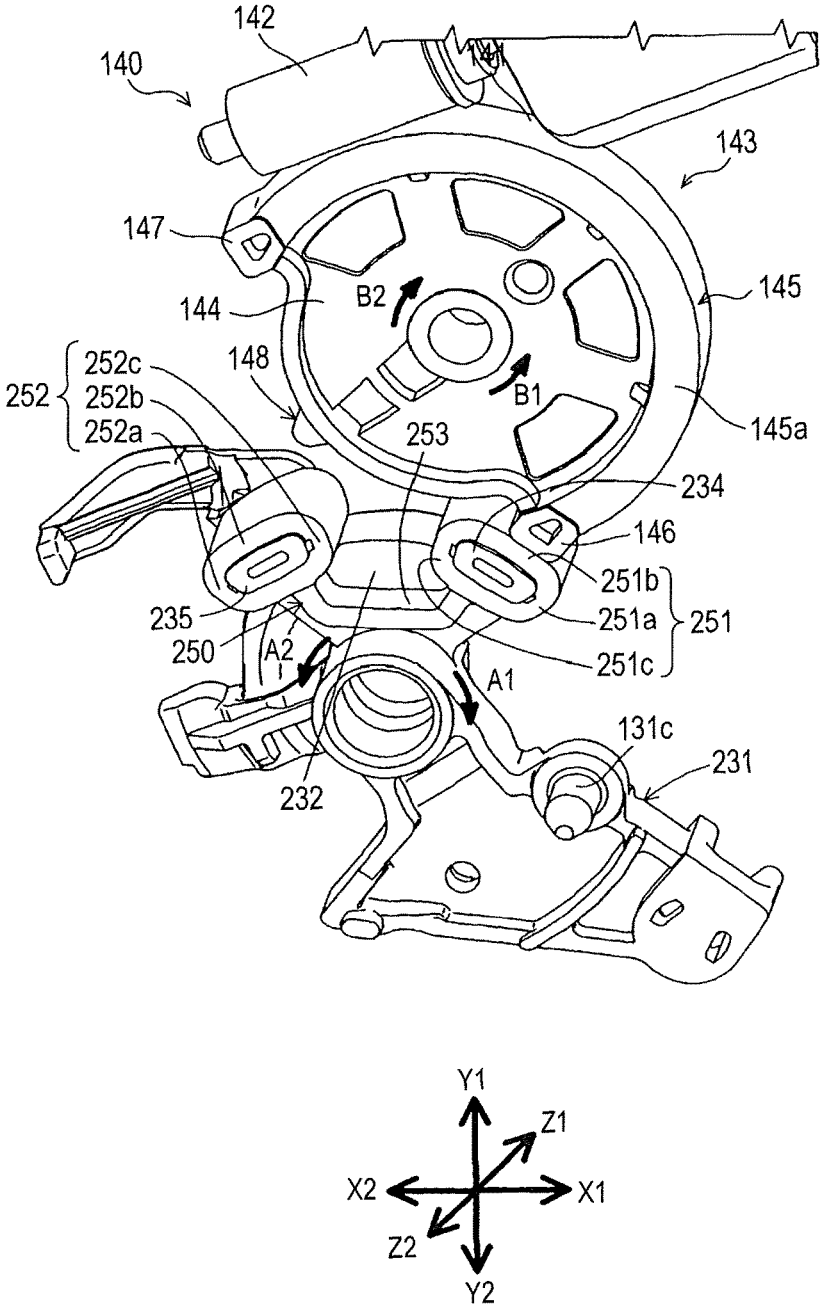
FIG. 9 is a view illustrating the state of engagement between the active lever at the unlock position and the wheel gear, viewed in the diagonal direction.

As illustrated in FIGS. 8 and 9, a first holding portion 234 and a second holding portion 235 are provided in the engaging arm 132 of the active lever 231, and are disposed away from each other. Both the first holding portion 234 and the second holding portion 235 are configured to extend along an arc line that is concentric with a lever support shaft 231*a* which is the center of turning of the active lever 231, and to protrude in an axial direction (toward the vehicle exterior side) of the lever support shaft 231*a*. The first holding portion 234 and the second holding portion 235 referred to here are respectively equivalent to a "first holding portion" and a "second holding portion" disclosed herein.

A belt member 250 made of rubber, which is a shock absorbing material, is fitted and attached to the first holding portion 234 and the second holding portion 235 such that the belt member 250 is held by the first holding portion 234 and the second holding portion 235. For this purpose, the belt member 250 is configured to include a first annular belt portion 251 that is fitted to the first holding portion 234; a second annular belt portion 252 that is fitted to the second holding portion 235; and a connection portion 253 through which the first belt portion 251 and the second belt portion 252 are connected to each other, and the first belt portion 251, the second belt portion 252, and the connection portion 253 of the belt member 250 are integrally formed. The belt member 250 is equivalent to a "shock absorbing member" and a "belt member" disclosed herein.

A plurality of (two in FIG. 8) retainers 234*a* are provided in an edge portion of the first holding portion 234 so as to prevent falling out of the first belt portion 251 from the first holding portion 234 to which the first belt portion 251 is fitted. Similarly, a plurality of (two in FIG. 8) retainers 235*a* are provided in an edge portion of the second holding portion 235 so as to prevent falling out of the second belt portion 252 from the second holding portion 235 to which the second belt portion 252 is fitted. The belt member 250 is reliably held by the active lever 231 by virtue of the retainers 234*a* and 235*a*.

The first belt portion 251 includes interposed portions 251*a*, 251*b*, and 251*c*, and has an annular structure in which the interposed portions are integrally formed. The interposed portion 251*a* is interposed in a first region between the first holding portion 234 of the active lever 231 and the stopper 124 of the housing 121. Accordingly, the first holding portion 234 is configured to be capable of coming into contact with the stopper 124, which corresponds to the first holding portion 234, via the interposed portion 251*a* of the first belt portion 251. The interposed portion 251*b* is interposed in a second region between the first holding portion 234 of the active lever 231 and the locking portion 146 of the wheel gear 143. Accordingly, the first holding portion 234 is configured to be capable of coming into contact with the locking portion 146, which corresponds to the first holding portion 234, via the interposed portion 251*b* of the first belt portion 251. The interposed portion 251*c* is interposed in a third region between the first holding portion 234 of the active lever 231 and the engaging protrusion 148 of the wheel gear 143. Accordingly, the first holding portion 234 is configured to be capable of coming into contact with the engaging protrusion 148, which corresponds to the first holding portion 234, via the interposed portion 251*c* of the first belt portion 251. The first belt portion 251 referred to here is equivalent to a "first belt portion" disclosed herein.

Similar to the first belt portion 251, the second belt portion 252 includes interposed portions 252*a*, 252*b*, and 252*c*, and has an annular structure in which the interposed portions are integrally formed. The interposed portion 252*a* is interposed in a first region between the second holding portion 235 of the active lever 231 and the stopper 125 of the housing 121. Accordingly, the second holding portion 235 is configured to be capable of coming into contact with the stopper 125, which corresponds to the second holding portion 235, via the interposed portion 252*a* of the second belt portion 252. The interposed portion 252*b* is interposed in a second region between the second holding portion 235 of the active lever 231 and the locking portion 147 of the wheel gear 143. Accordingly, the second holding portion 235 is configured to be capable of coming into contact with the locking portion 147, which corresponds to the second holding portion 235, via the interposed portion 252*b* of the second belt portion 252. The interposed portion 252*c* is interposed in a third region between the second holding portion 235 of the active lever 231 and the engaging protrusion 148 of the wheel gear 143. Accordingly, the second holding portion 235 is configured to be capable of coming into contact with the engaging protrusion 148, which corresponds to the second holding portion 235, via the interposed portion 252*c* of the second belt portion 252. The second belt portion 252 referred to here is equivalent to a "second belt portion" disclosed herein.

Hereinafter, a turning operation of the active lever 231 with the aforementioned configuration from the unlock position to the lock position performed by the actuator 140 will be described with reference to FIGS. 10 and 11 in addition to FIG. 8. A turning operation of the active lever 231 from the lock position to the unlock position can be described in a sequence reverse to that of the following operation, and thus description thereof will be omitted.

In a state where the active lever 231 is present at the unlock position illustrated in FIG. 8, the locking portion 146 of the wheel gear 143 is in contact with the first holding portion 234 of the active lever 231 via the interposed portion 251*b* of the first belt portion 251 of the belt member 250. In this state, the active lever 231 locks the wheel gear 143 at the unlock position due to contact between the wheel gear 143 and the interposed portion 251*b*. When the wheel gear 143 is rotated in the first direction B1, the first holding portion 234 of the active lever 231 is engaged with the engaging protrusion 148 of the wheel gear 143 via the interposed portion 251*c* of the first belt portion 251 of the belt member 250, and the turning position of the active lever 231 sequentially transitions to states illustrated in FIGS. 10 and 11. A first position illustrated in FIG. 10 is a position to which the engaging protrusion 148 of the wheel gear 143 is turned a predetermined angle from an initial position in the first direction B1. A second position illustrated in FIG. 11 is a position to which the engaging protrusion 148 is further turned from the first position in the first direction B1.

Figure 10:
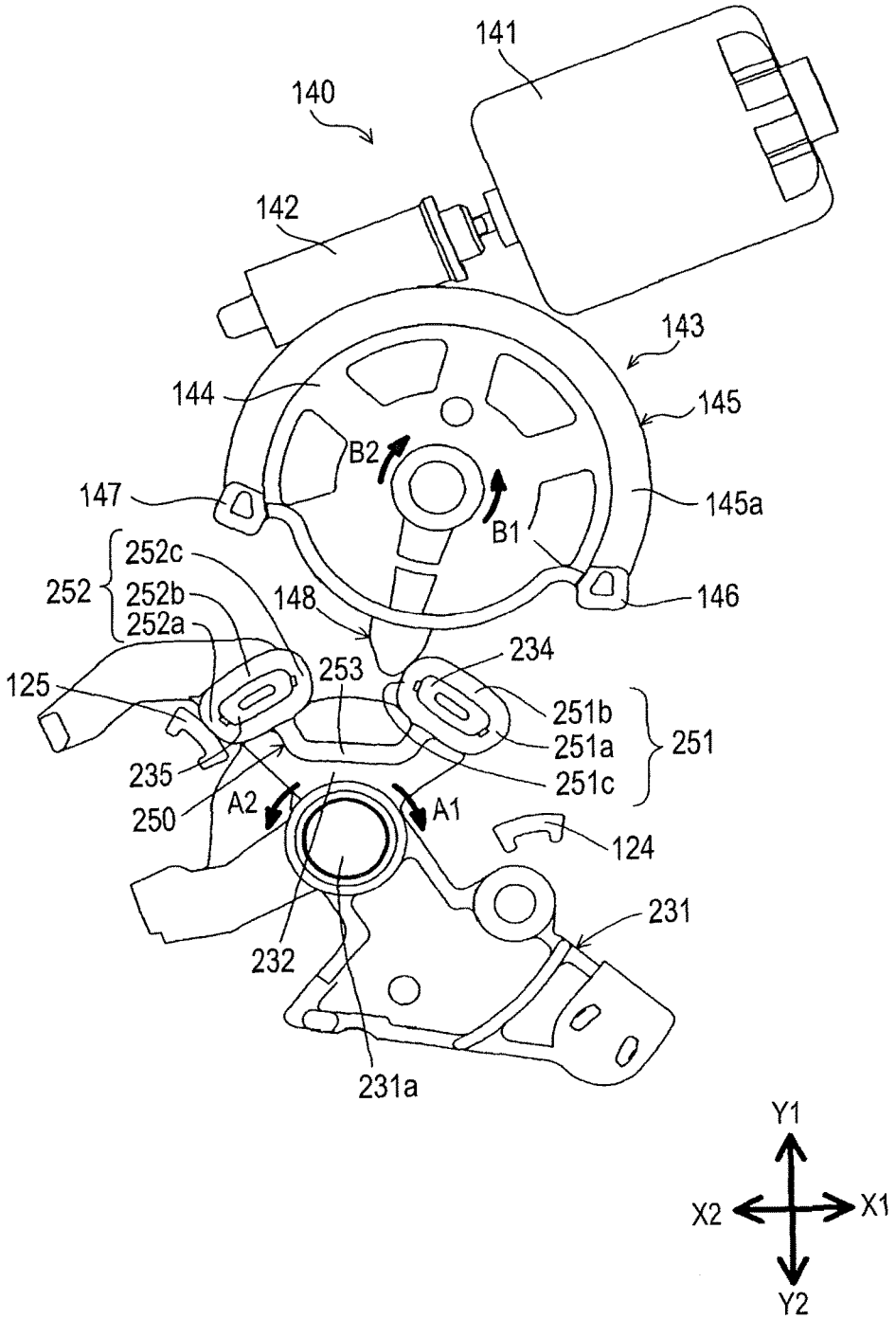
FIG. 10 is a view illustrating a state in which the engaging protrusion of the wheel gear is in contact with a first holding portion of the active lever at the unlock position via a belt member.

As illustrated in FIG. 10, when the engaging protrusion 148 of the wheel gear 143 reaches the first position, the engaging protrusion 148 comes into contact with the first holding portion 234 of the active lever 231 via the interposed portion 251*c* of the first belt portion 251. The active lever 231 is pressed toward the lock position by further turning of the engaging protrusion 148 in the first direction B1. Accordingly, the active lever 231 is turned in the first direction A1 overcoming an elastic biasing force (force to bias the active lever 231 in the second direction A2) of the spring (the spring 160 in FIG. 1). During this process, an elastic biasing direction of the spring is switched, and thereafter, the active lever 231 is turned in the first direction A1 according to the elastic biasing force of the spring.

Figure 11:
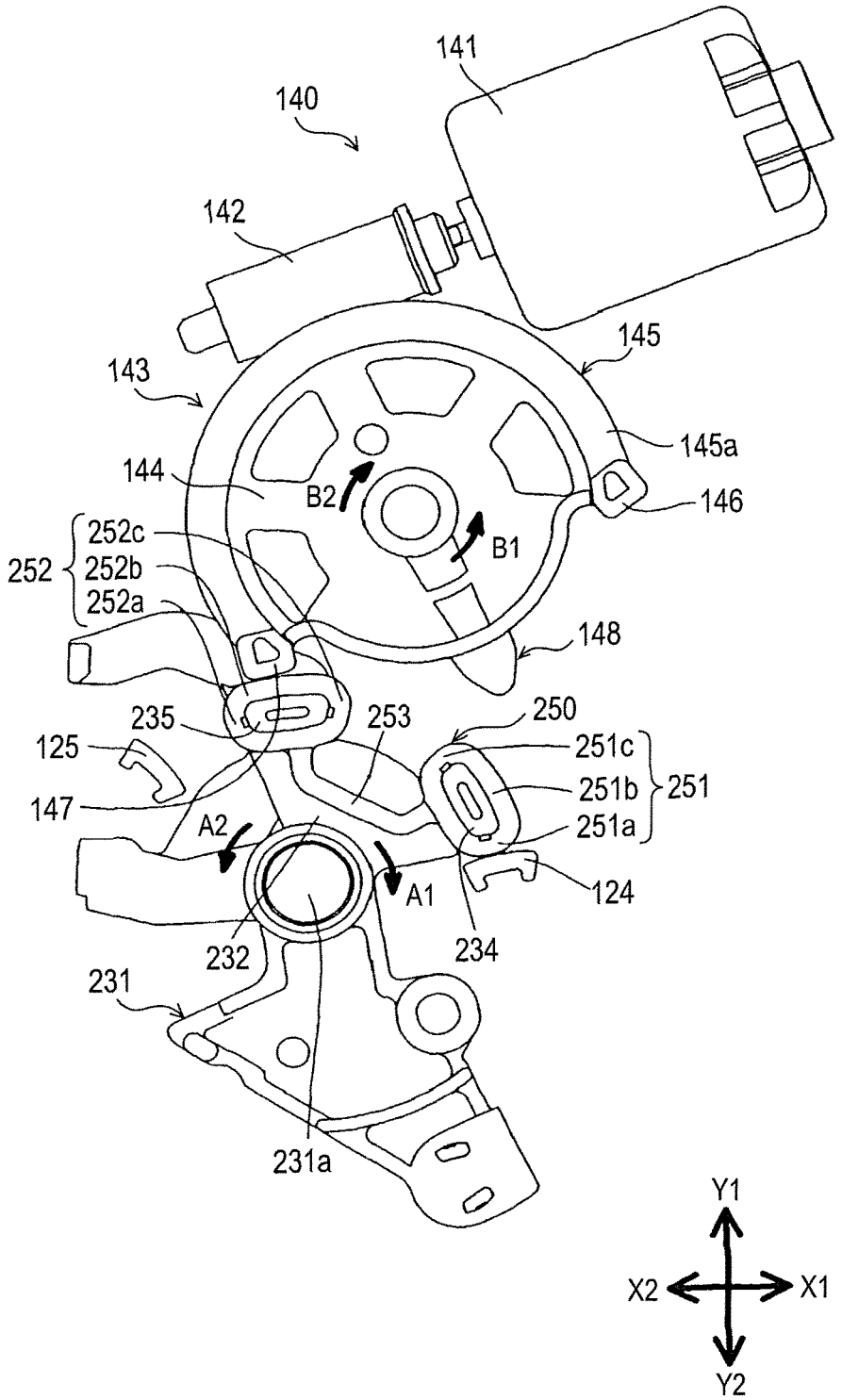
FIG. 11 is a view illustrating the state of engagement between the active lever at the lock position and the wheel gear, viewed from the vehicle exterior side.

As illustrated in FIG. 11, when the active lever 231 is turned to the lock position, the locking portion 147 of the wheel gear 143 comes into contact with the second holding portion 235 of the active lever 231 via the interposed portion 252*b* of the second belt portion 252. The active lever 231 locks the wheel gear 143 at the lock position due to contact between the wheel gear 143 and the interposed portion 252*b*. In this case, since the locking portion 147 is indirectly engaged with the second holding portion 235 with the second belt portion 252 made of rubber interposed between the locking portion 147 and the second holding portion 235, striking noise induced by engagement is reduced. Thereafter, the first holding portion 234 of the active lever 231 comes into contact with the stopper 124 of the housing 121 via the interposed portion 251*a* of the first belt portion 251. As a result, the turning of the active lever 231 in the first direction A1 is prevented by the stopper 124. In this case, since the stopper 124 is indirectly engaged with the first holding portion 234 in a state where the first belt portion 251 of the belt member 250 made of rubber is interposed between the stopper 124 and the first holding portion 234, striking noise induced by engagement is reduced.

In this configuration, the belt member 250 is capable of reducing operation noise (striking noise) induced by engagement between the active lever 231 and the stopper 124 or 125 and between the active lever 231 and the wheel gear 143 during an operation of the actuator 140. Particularly, since one common belt member 250 is used for the first to third regions which are striking noise-inducing regions, it is possible to simplify the structure and to reduce the product cost.

This disclosure is not limited to the aforementioned typical embodiment, and various applications or modifications can be considered. For example, the following examples can be realized as applications of the aforementioned embodiment.

In the door lock devices of the aforementioned embodiment, the belt members 150 and 250 are made of rubber which is a shock absorbing material; however, in this disclosure, the belt members 150 and 250 may be made of shock absorbing materials (for example, resin, or foam (sponge)) other than rubber.

The door lock device of the aforementioned embodiment adopts a structure in which a portion of the shock absorbing member is interposed in each of the first and second regions among the three striking noise-inducing regions, or a structure in which a portion of the shock absorbing member is interposed in each of the first to third regions; however, in this disclosure, the door lock device may adopt a structure in which a portion of the shock absorbing member is interposed in each of the first and third regions, or a structure in which a portion of the shock absorbing member is interposed in each of the second and third regions.

In this disclosure, the essential structure of the door lock device 100 can be applied to each vehicle door of a vehicle. For example, the essential structure of the door lock device 100 in the embodiment disclosed herein can be applied to right and left side doors for vehicle front seats, right and left side doors for vehicle rear seats, and a rear side vehicle door (back door).

A vehicle door lock device according to an aspect of this disclosure is assembled to a vehicle door and includes a latch mechanism and a lock mechanism. The latch mechanism is configured to be capable of holding the vehicle door in a closed state with respect to a vehicle body. The lock mechanism serves to set the latch mechanism to an unlock state in which engagement between the latch mechanism and a striker provided in the vehicle body can be released, or a lock state in which engagement between the latch mechanism and the striker cannot be released. The lock mechanism further includes a drive gear, a wheel gear, an active lever, stoppers, and one shock absorbing member.

The drive gear is driven by an electric motor. The wheel gear includes a body portion that is rotatably supported by a housing; a gear portion that is provided along an outer circumference of the body portion and includes gear teeth on an outer circumferential surface of the body portion, which is engaged with the drive gear; locking portions that are respectively provided in circumferential end portions of the gear portion, and an engaging protrusion that is provided in the body portion and protrudes toward the radial outside of the body portion. The active lever includes an engaging recess that can be engaged with the engaging protrusion of the wheel gear. The active lever is turned in either direction of a first direction from an unlock position at which the latch mechanism is set to the unlock state toward a lock position at which the latch mechanism is set to the lock state, or a second direction from the lock position toward the unlock position, in a state where the engaging protrusion is engaged with the engaging recess during rotation of the wheel gear. The active lever locks the wheel gear at each of the unlock position and the lock position. The stoppers are respectively provided on both sides of the active lever in the housing, prevent further turning of the active lever, which has been turned from the lock position to the unlock position, in the first direction, and prevent further turning of the active lever, which has been turned from the unlock position to the lock position, in the second direction.

The shock absorbing member is attached to the active lever, includes a plurality of interposed portions which are integrally formed and are interposed in at least two regions among a first region between the active lever and the stopper of the housing, a second region between the active lever and the locking portion of the wheel gear, and a third region between the engaging recess of the active lever and the engaging protrusion of the wheel gear, and is made of a shock absorbing material. In this case, the interposed portions of the shock absorbing member are respectively interposed in two or more regions selected from three regions. The "shock absorbing material" referred to here is a material having a mechanism in which the material is deformed such that an external impact and vibration are reduced. Examples of the typical shock absorbing materials include rubber, resin, and foam (sponge). Accordingly, the active lever is indirectly engaged with each of the stopper and the wheel gear via the shock absorbing member. As a result, the shock absorbing member is capable of reducing operation noise (striking noise) induced by engagement between the active lever and the stopper and between the active lever and the wheel gear during an operation of the electric motor. In addition, since one common shock absorbing member is used for a plurality of striking noise-inducing regions, it is possible to simplify the structure and to reduce the product cost.

In the vehicle door lock device with the aforementioned configuration, it is preferable that the plurality of interposed portions of the shock absorbing member include an interposed portion that is interposed in the second region. The second region, in which the active lever is engaged with the locking portion of the wheel gear, is known as a region in which operation noise is highly likely to be induced among the three striking noise-inducing regions. Even if the number of interposed portions is small, it is possible to obtain a significant effect of preventing the induction of striking noise by interposing a portion of the shock absorbing member in at least the second region.

In the vehicle door lock device with the aforementioned configuration, it is preferable that the active lever includes a holding portion that extends along an arc line which is concentric with the center of turning of the active lever, and protrudes in the direction of a rotational axis of the active lever. It is preferable that the shock absorbing member is a belt member that is formed into an annular shape to include a plurality of interposed portions which are respectively interposed in the first region and the second region, and is fitted to the holding portion. It is preferable that the holding portion is configured to be capable of coming into contact with each of the stopper and the locking portion via the belt member. In this configuration, it is possible to obtain the effect of preventing striking noise from being induced in the first region and the second region which are striking noise-inducing regions.

In the vehicle door lock device with the aforementioned configuration, it is preferable that the active lever includes a first holding portion and a second holding portion that extend along an arc line which is concentric with the center of turning of the active lever, protrude in the direction of a rotational axis of the active lever, and are disposed away from each other. It is preferable that the shock absorbing member is an integral belt member configured to include a first belt portion; a second belt portion; and a connection portion through which the first belt portion and the second belt portion are connected to each other. In this case, the first belt portion is formed into an annular shape to include a plurality of interposed portions which are respectively interposed in the first region, the second region, and the third region, all of which are assigned to the first holding portion, and is fitted to the first holding portion. The second belt portion is formed into an annular shape to include a plurality of interposed portions which are respectively interposed in the first region, the second region, and the third region, all of which are assigned to the second holding portion, and is fitted to the second holding portion. It is preferable that the first holding portion is configured to be capable of coming into contact with each of the stopper, the engaging protrusion, and the locking portion, all of which correspond to the first holding portion, via the first belt portion of the belt member. The second holding portion is preferably configured to be capable of coming into contact with each of the stopper, the engaging protrusion, and the locking portion, all of which correspond to the second holding portion, via the second belt portion of the belt member. In this configuration, it is possible to obtain the effect of preventing striking noise from being induced in the first region, the second region, and the third region which are striking noise-inducing regions.

As described above, in the vehicle door lock device according to the aspect of this disclosure, it is possible to reduce operation noise of the actuator by implementing a low-cost structure.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a latch mechanism configured to be capable of holding a vehicle door in a closed state with respect to a vehicle body; and a lock mechanism that sets the latch mechanism to an unlock state in which engagement between the latch mechanism and a striker provided in the vehicle body can be released, or a lock state in which engagement between the latch mechanism and the striker cannot be released, wherein the lock mechanism includes a drive gear that is driven by an electric motor, a wheel gear including a body portion that is rotatably supported by a housing, a gear portion that is provided along an outer circumference of the body portion and includes gear teeth on an outer circumferential surface of the body portion, which is engaged with the drive gear, locking portions that are respectively provided in circumferential end portions of the gear portion, and an engaging protrusion that is provided in the body portion and protrudes toward a radial outside of the body portion, an active lever that includes an engaging recess which can be engaged with the engaging protrusion of the wheel gear, is turned in either direction of a first direction from an unlock position at which the latch mechanism is set to the unlock state toward a lock position at which the latch mechanism is set to the lock state, or a second direction from the lock position toward the unlock position, in a state where the engaging protrusion is engaged with the engaging recess during rotation of the wheel gear, and locks the wheel gear at each of the unlock position and the lock position, stoppers that are respectively provided on both sides of the active lever in the housing, prevent further turning of the active lever which has been turned from the lock position to the unlock position, in the first direction, and prevent further turning of the active lever which is turned from the unlock position to the lock position, in the second direction, a shock absorbing member that is attached to the active lever, includes a plurality of interposed portions which are integrally formed and are interposed in at least two regions among a first region between the active lever and a respective one of the stoppers, a second region between the active lever and a respective one of the locking portions of the wheel gear, and a third region between the engaging recess of the active lever and the engaging protrusion of the wheel gear, and is made of a shock absorbing material, wherein the plurality of interposed portions of the shock absorbing member include an interposed portion that is interposed in the second region, wherein the active lever includes a first holding portion and a second holding portion that extend along an arc line which is concentric with a center of turning of the active lever, protrude in an axial direction of the active lever, and are disposed away from each other, wherein the shock absorbing member is an integral belt member configured to include a first belt portion that is formed into an annular shape to include a plurality of interposed portions which are respectively interposed in the first region, the second region, and the third region, all of which are assigned to the first holding portion, and is fitted to the first holding portion; a second belt portion that is formed into an annular shape to include a plurality of interposed portions which are respectively interposed in the first region, the second region, and the third region, all of which are assigned to the second holding portion, and is fitted to the second holding portion; and a connection portion through which the first belt portion and the second belt portion are connected to each other, and wherein the first holding portion is configured to be capable of coming into contact with each of a respective one of the stoppers, the engaging protrusion, and a respective one of the locking portions, all of which correspond to the first holding portion, via the first belt portion of the integral belt member, and the second holding portion is configured to be capable of coming into contact with each of a respective one of the stoppers, the engaging protrusion and a respective one of the locking portions, all of which correspond to the second holding portion, via the second belt portion of the integral belt member.

* * * * *